US009046272B2

(12) United States Patent
Rice

(10) Patent No.: US 9,046,272 B2
(45) Date of Patent: Jun. 2, 2015

(54) COMBUSTION LINER ASSEMBLY HAVING A MOUNT STAKE COUPLED TO AN UPSTREAM SUPPORT

(75) Inventor: Edward Claude Rice, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1136 days.

(21) Appl. No.: 12/625,349

(22) Filed: Nov. 24, 2009

(65) Prior Publication Data

US 2010/0199684 A1 Aug. 12, 2010

Related U.S. Application Data

(60) Provisional application No. 61/204,036, filed on Dec. 31, 2008.

(51) Int. Cl.
*F23R 3/60* (2006.01)

(52) U.S. Cl.
CPC ..... *F23R 3/60* (2013.01); *Y10T 29/49229* (2015.01)

(58) Field of Classification Search
CPC ..... F23R 3/60; F23R 3/286; F23R 3/04; F23R 3/00; F23R 3/002; F23R 3/28; F23R 3/283; F23R 3/30; F23R 3/32; F23R 3/34; F23R 3/343; F23R 3/346; F02C 7/20
USPC ..... 60/737, 740, 746, 747, 748, 751, 752, 60/753, 754, 755, 756, 757, 758, 759, 760, 60/796, 797, 798, 799, 800, 772
See application file for complete search history.

(56) References Cited

U.S. PATENT DOCUMENTS

| | | | | |
|---|---|---|---|---|
| 2,676,460 | A * | 4/1954 | Brown | 60/742 |
| 3,049,882 | A * | 8/1962 | Labastie et al. | 60/751 |
| 3,166,904 | A * | 1/1965 | Melenric | 60/746 |
| 3,327,473 | A * | 6/1967 | Smith | 60/796 |
| 3,372,542 | A * | 3/1968 | Sevetz | 60/748 |
| 3,398,529 | A * | 8/1968 | Schmitz et al. | 60/796 |
| 3,750,397 | A * | 8/1973 | Cohen et al. | 60/804 |
| 3,899,884 | A * | 8/1975 | Ekstedt | 60/737 |
| 4,458,479 | A * | 7/1984 | Reider et al. | 60/800 |
| 4,466,240 | A * | 8/1984 | Miller | 60/796 |
| 5,289,677 | A | 3/1994 | Jarrell | |
| 5,524,430 | A | 6/1996 | Mazeaud et al. | |
| 6,334,298 | B1 | 1/2002 | Aicholtz | |
| 6,401,447 | B1 | 6/2002 | Rice et al. | |
| 6,438,959 | B1 | 8/2002 | Dean et al. | |
| 6,513,330 | B1 * | 2/2003 | Rice et al. | 60/751 |
| 6,651,439 | B2 | 11/2003 | Al-Roub et al. | |
| 6,851,263 | B2 | 2/2005 | Stumpf et al. | |
| 7,493,771 | B2 * | 2/2009 | Lohmueller et al. | 60/796 |
| 7,966,832 | B1 * | 6/2011 | Lockyer et al. | 60/800 |
| 7,975,487 | B2 * | 7/2011 | Lockyer et al. | 60/752 |
| 2004/0134198 | A1 | 7/2004 | Mitchell et al. | |
| 2006/0042269 | A1 | 3/2006 | Markarian et al. | |
| 2008/0092547 | A1 * | 4/2008 | Lockyer et al. | 60/757 |
| 2009/0188255 | A1 * | 7/2009 | Green et al. | 60/737 |
| 2011/0283711 | A1 * | 11/2011 | Petersson et al. | 60/796 |

* cited by examiner

*Primary Examiner* — Phutthiwat Wongwian
*Assistant Examiner* — Michael B Mantyla
(74) *Attorney, Agent, or Firm* — Krieg DeVault LLP

(57) ABSTRACT

A combustor liner assembly support is provided that is used to axially and radially position combustor liners in a gas turbine engine. The combustor liner support includes, in one embodiment, a support bracket that is coupled to a diffuser located upstream in the gas turbine engine; a support spool coupled to the support bracket; and a mount stake coupled to the support spool. The mount stake is connected to the combustor liners and maintains the spaced relation therebetween. An alignment device can be used between the support bracket and the support spool.

19 Claims, 3 Drawing Sheets

COMBUSTION LINER ASSEMBLY HAVING A MOUNT STAKE COUPLED TO AN UPSTREAM SUPPORT

CROSS REFERENCE TO RELATED APPLICATIONS

The present application claims the benefit of U.S. Provisional Patent Application 61/204,036, filed Dec. 31, 2008, and is incorporated herein by reference.

FIELD OF THE INVENTION

The present invention generally relates to gas turbine engine combustors, and more particularly, but not exclusively, to combustion liner assembly supports.

BACKGROUND

In one form of a gas turbine engine, a combustor includes, among other things, inner and outer casings and inner and outer liners, wherein the inner and outer liners are disposed between the inner and outer casings. In some prior combustor designs, the inner and outer liners are supported and maintained in spaced relation to each other with a mount stake that traverses between the combustor inner and outer casings and is secured in place by bosses or mount pads formed in the casings. For example, FIG. 1 depicts a combustor 50 having an inner casing 55 spaced apart from an outer casing 60 and having disposed therebetween an inner liner 65 and an outer liner 70. A fuel nozzle 75 is positioned between the inner liner 65 and the outer liner 70. A mount stake 80 traverses from an inner side 85 to an outer side 90 of the combustor 50 and is structured to maintain in spaced relation the inner liner 65 and the outer liner 70. An inner mount pad or boss 95 and an outer mount pad or boss 100 are configured in the inner casing 55 and the outer casing 60, respectively, and serve to secure the mount stake 80, and therefore the inner liner 65 and the outer liner 70, in axial and radial position within the combustor 50.

Arranging, orienting, and/or securing certain components of gas turbine engine combustors remains an area of interest. Some existing systems have various shortcomings relative to certain applications. Accordingly, there remains a need for further contributions in this area of technology.

SUMMARY OF THE INVENTION

One embodiment of the present invention is a unique gas turbine engine combustor. Other embodiments include apparatuses, systems, devices, hardware, methods, and combinations for combustion liner assembly supports. Further embodiments, forms, features, aspects, benefits, and advantages of the present application shall become apparent from the description and figures provided herewith.

DETAILED DESCRIPTION OF REPRESENTATIVE EMBODIMENTS

Figure 1:
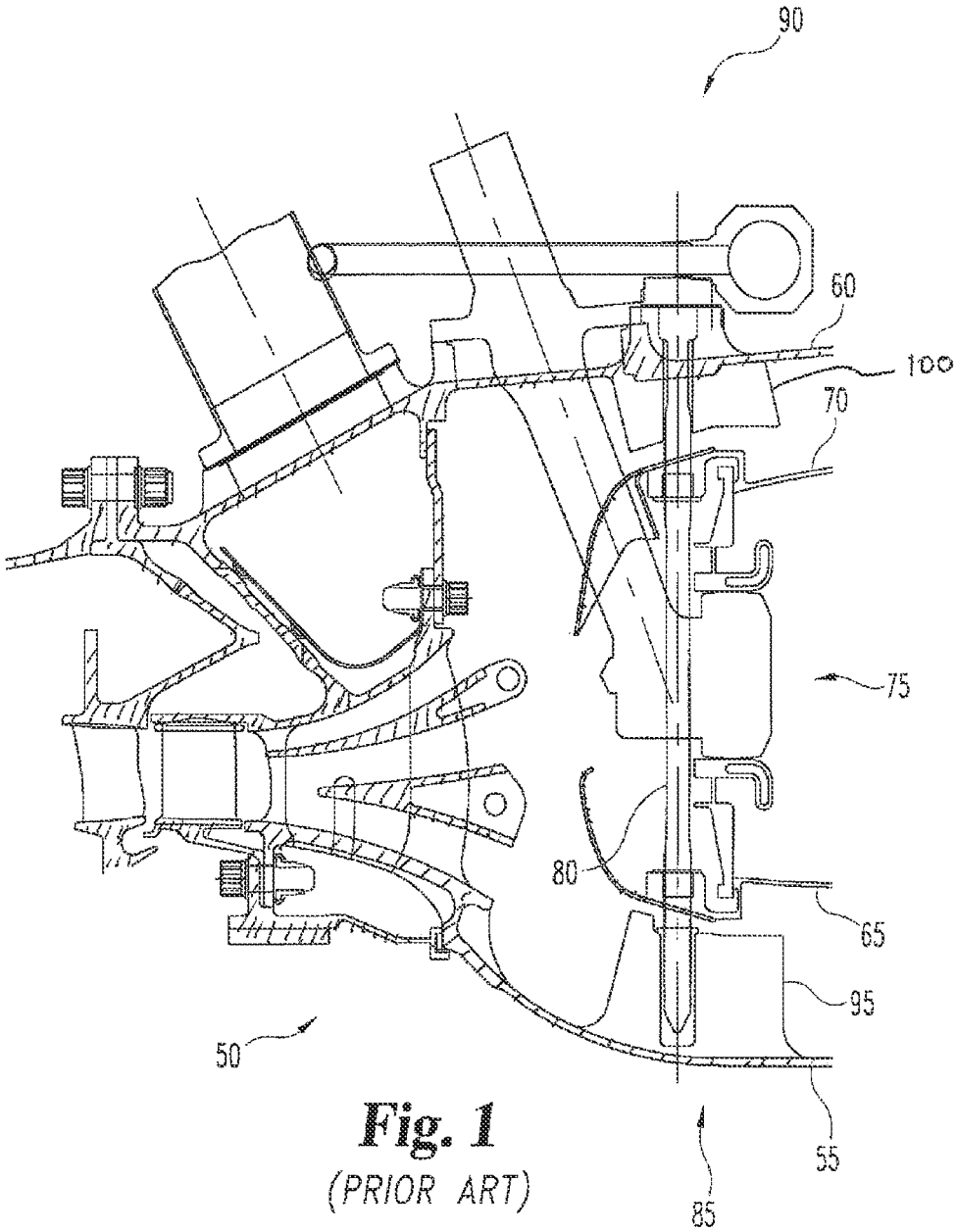
Fig. 1 (PRIOR ART)
FIG. 1 depicts a prior art combustor.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
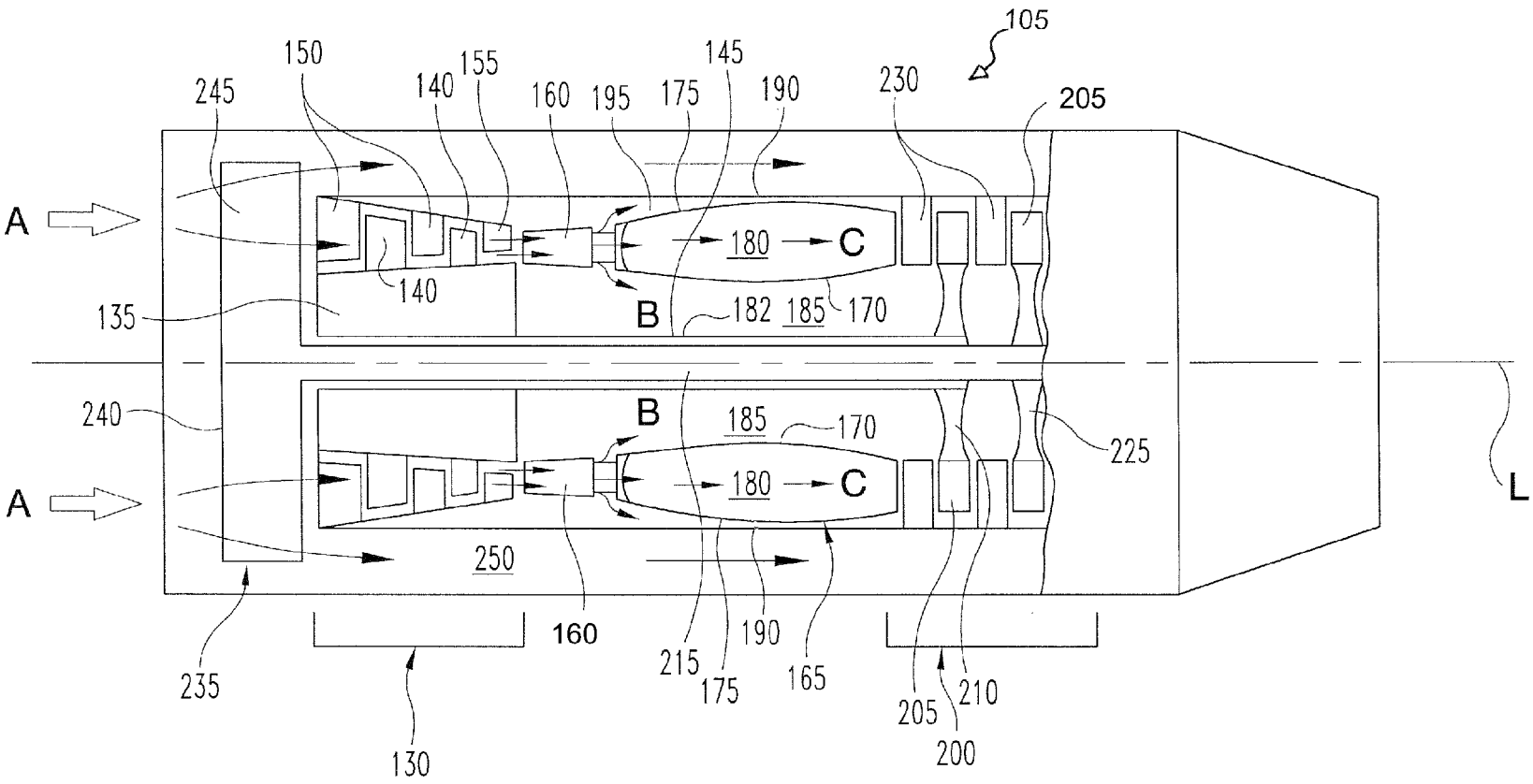
FIG. 2 depicts a schematic of a gas turbine engine.

With reference to FIG. 2, there is illustrated a schematic representation of a gas turbine engine 105. In one form, the gas turbine engine 105 includes a longitudinal axis L extending generally along the gaseous flow stream and has an annular configuration; however, other configurations are also contemplated as would occur to one of ordinary skill in the art. The gas turbine engine 105 of the illustrative embodiment includes a fan section 235, a compressor section 130, a combustor section 165, and a turbine section 200 integrated to produce an aircraft flight propulsion engine. This particular form of a gas turbine engine is generally referred to as a turbo-fan. However, it should be understood that the invention described herein is applicable to all types of gas turbine engines, such as turbojets to set forth just one nonlimiting example, and is not intended to be limited to the gas turbine engine schematic represented in FIG. 1. Another form of a gas turbine engine includes a compressor section, a combustor section, and a turbine section integrated to produce an aircraft flight propulsion engine without a fan section.

The term aircraft includes, but is not limited to, airplanes, unmanned space vehicles, fixed wing vehicles, variable wing vehicles, unmanned combat aerial vehicles, tailless vehicles, and others. Further, the present inventions are contemplated for utilization in other applications that may not be coupled with an aircraft such as, for example, industrial applications, power generation, pumping sets, naval propulsion and other applications known to one of ordinary skill in the art.

In the illustrative embodiment, the multi-stage compressor section 130 includes a rotor 135 having a plurality of compressor blades 140 coupled thereto. The rotor 135 is affixed to a shaft 145 which is rotatably mounted within the gas turbine engine 105. A plurality of compressor vanes 150 are positioned adjacent the compressor blades 140 to direct the flow of gaseous fluid through the compressor section 130. In a preferred embodiment, the gaseous fluid is air; however, the present invention also contemplates other gaseous fluids. Located at the downstream end of the compressor section 130 is a series of compressor outlet vanes 155 for directing the flow of air into a diffuser 160. The diffuser 160 conditions the compressed air by reducing its velocity and increasing static pressure and then discharges the conditioned air into the combustor section 165 for subsequent combustion.

The combustor section 165 includes an inner combustor liner 170 and an outer combustor liner 175 spaced apart to define a combustion chamber 180 therebetween. In one form, the inner combustor liner 170 is spaced from the shaft 145, or alternatively, from an inner combustor casing 182, to define an annular fluid passage 185. The outer combustor liner 175 is preferably spaced from an outer casing 190 to define an annular fluid passage 195.

The turbine section 200 includes a plurality of turbine blades 205 coupled to a rotor disk 210, which in turn is coupled to a shaft 215. A plurality of turbine blades 205 are coupled to a rotor disc 225, which in turn is coupled to the shaft 215. A plurality of turbine vanes 230 are positioned adjacent the turbine blades 205 to direct the flow of the hot gaseous fluid stream generated by the combustor section 165 through the turbine section 200.

In operation, the turbine section 200 provides rotational power to the shafts 215 and 145, which in turn drive the fan section 235 and the compressor section 130, respectively. The fan section 235 includes a fan 240 having a plurality of fan blades 245. Air enters the gas turbine engine 105 in the direction of arrows A, passes through the fan section 235, and is provided to the compressor section 130 and a bypass duct 250. At least a portion of the compressed air exiting the compressor section 130 is routed into a diffuser 160. The diffuser 160 conditions the compressed air and directs the conditioned air into the combustion chamber 180 and the fluid passages 185, 195 in the direction of arrows B.

A portion of the conditioned air enters the combustion chamber 180 at its upstream end, where the conditioned air is intermixed with fuel to provide an air/fuel mixture. The air/fuel mixture is ignited and burned in the combustion chamber 180 to generate a hot gaseous fluid stream flowing through the combustion chamber 180 in the direction of arrows C. The hot gaseous fluid stream is provided to the turbine section 200 to provide the energy necessary to power the gas turbine engine 105. The remaining portion of the conditioned air exiting the diffuser 160 flows through the fluid passages 185, 195 to cool the inner and outer combustor liners 170, 175 and other engine components. Further details regarding the general structure and operation of a gas turbine engine are believed to be well known to those skilled in the art and are therefore deemed unnecessary for a full understanding of the principles of the present application.

Figure 3:
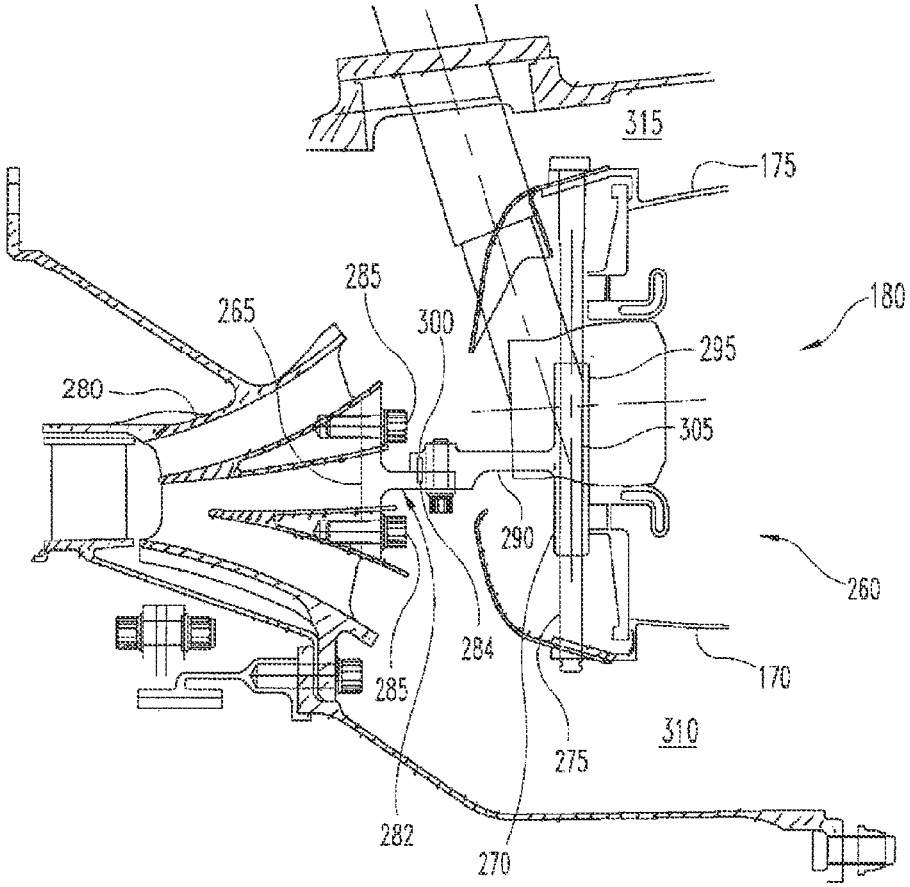
FIG. 3 depicts one form of a liner assembly support.

Referring to FIG. 3, there is illustrated a cross sectional view of a portion of the gas turbine engine 105 (as seen in FIG. 2), illustrating a combustor apparatus according to one form of the present application. The combustor apparatus of the illustrative embodiment in FIG. 3 is comprised of the inner and outer combustor liners 170, 175 and a combustor liner assembly support 260. In one form the combustor liner assembly support 260 includes a support bracket 265, a support spool 270, and a mount stake 275 and is used to secure, orient, and/or align the inner and outer combustor liners 170 and 175 within the gas turbine engine 105. In some embodiments, the combustor liner assembly support 260 can include fewer parts. For example, the combustor liner assembly support 260 may include only the support bracket 265 and the support spool 270, to set forth just one non-limiting example. Furthermore, one or more parts that are used in the combustor liner assembly support 260, or one or more portions of parts, can be integrally formed, some examples of which are discussed further below. Multiple combustor liner assembly supports can be used within the gas turbine engine 105 at a variety of circumferential locations.

In one form the support bracket 265 includes a support flange 282 and is used to attach the combustor liner assembly support 260 to a diffuser 280 at a point upstream of the combustor chamber 180. In other embodiments the support bracket 265 can be attached at any point relative to the combustion chamber 180. For example, the support bracket 265 can be attached to a gas turbine structure other than a diffuser. Furthermore, the support bracket 265 can be integrally formed with the diffuser 280 in some embodiments. As will be appreciated, the diffuser 280 is depicted as a tri-pass diffuser splitter but can take on different forms in other embodiments, such as a single- or dual-pass diffuser.

In the illustrative form the support flange 282 extends axially from the support bracket 265 and includes an alignment aperture 284 used in conjunction with other structures described below to align the combustor liner assembly support 260 within the gas turbine engine 105. In other embodiments, the support flange 282 can extend radially and/or can extend in a non-linear fashion, such as, but not limited to, a dog-leg. The support bracket 265 is secured to the diffuser 280 by bolts 285. In other embodiments, however, the support bracket 265 can additionally and/or alternatively be secured with other techniques, such as welding to set forth just one non-limiting example.

The support spool 270 includes a support spool arm 290 and a sleeve 295 and is used in the illustrative embodiment to connect the mount stake 275 with the support bracket 265. The support spool 270 can be attached to the support bracket 265 using any variety of techniques, such as screws to set forth just one non-limiting example. In some embodiments the support spool 270 can be formed with the support bracket 265 to form an integrated support assembly. In one form of the present application the support spool arm 290 includes an arm aperture capable of receiving an alignment device that cooperates with an arm aperture 300 and the alignment aperture 284 of the support bracket 265. The alignment device can take on any suitable form such as a locating pin and is used to axially align the combustor liner assembly support 260. Other types of alignment techniques are also contemplated. To set forth a few non-limiting examples, irregular and/or serrated edges can be formed in the support spool arm 290 and the support flange 282 that permit only one way of attachment.

The sleeve 295 partially extends between the inner combustor liner 170 and the outer combustor liner 175 and has an aperture with a cross sectional shape complementary to the cross sectional shape of the mount stake 275. In other embodiments the sleeve 295 can fully extend between the combustor liners 170 and 175 or may only extend partially from one liner. The sleeve 295 can have a length to diameter ratio that alleviates wear between the mount stake 275 and support spool 270 while providing necessary support for the combustion liner assembly. In still other embodiments, multiple sleeves can be arranged at the end of a bifurcated support spool arm 290, such that the mount stake 275 is received through both sleeves. Such would be the case with the support spool arm 290 that is shaped like a "C", or a "V", or any other suitable shape. Some spool support arms can be further split into more than two arms such as would be the case with, for example, "W" shapes.

A passageway 305 is formed in the sleeve 295 of the illustrated embodiment and has a cross sectional shape complementary with the shape of the mount stake 275 such that the passageway 305 can slidingly receive the mount stake 275. In other embodiments, however, the passageway 305 need not slidingly receive the mount stake. For example, the sleeve 295 can be partially open such as a channel or groove to allow the mount stake 275 to be grasped by or placed within the passageway 305. Such would be the case with the passageway 305 having a "C" cross-sectional shape.

Furthermore, in other embodiments the cross sectional shapes of the passageway 305 and the mount stake 275 may not be complementary. In operation, the mount stake 275 can be allowed to slide within the passageway 305 or may be fixed thereto, either permanently or releasably. In some embodiments, the sleeve 295 can be integrally formed with the mount stake 275. In still further embodiments, the support spool 270 can be integrally formed with the support bracket 265.

The mount stake 275 is configured to retain the inner combustor liner 170 and the outer combustor liner 175 in spaced relation and is held in place, as discussed above, with the support spool 270. The mount stake 275 can have any variety of cross sectional shapes which can vary along its length. The mount stake 275 extends radially across the combustion chamber 180 between the inner combustor liner 170 and the outer combustor liner 175, but in some embodiments may extend partially or fully across either or both of flowpaths 310 and 315. Though depicted as an elongated member, the mount stake 275 can have different shapes in other embodiments such as a "V" or "W" shape, among others. Inner combustor and outer combustor liners 170 and 175 can be secured to the mount stake 275 through a variety of mechanisms, such as by clipping, screwing, welding, or snapping, to set forth just a few non-limiting examples.

One aspect of the present application includes a support structure operable to couple a mount stake traversing between combustor liners to a fixed structure of a gas turbine engine such as a compressor diffuser. The support structure includes a support bracket and a support spool. In one embodiment the support bracket is coupled to the diffuser while the support spool is coupled to the mount stake at a point intermediate the ends of the mount stake. The mount stake may only extend between the combustor liners and may, or may not, extend across all flow paths to a combustor casing.

Another aspect of the present application includes a gas turbine engine having a combustor support bracket and a support spool extending from the combustor support bracket, wherein the support spool is structured to support a combustor liner mount stake.

One feature of the present application includes a mount stake operable to be coupled to the support spool and having a first end attached to an inner liner and a second end attached to an outer liner, wherein the mount stake is structured to maintain the inner liner and outer liner in spaced relation.

Another feature of the present application includes a passageway defined in the support spool, wherein the mount stake is capable of being received within the passageway.

Yet another feature of the present application includes an alignment device.

Still another feature of the present application includes a diffuser, wherein the support bracket is capable of being coupled to the diffuser.

Yet another aspect of the present application includes a gas turbine engine combustor comprising inner and outer combustor liners, a mount stake having a first end and a second end, the mount stake traversing between the inner and outer combustor liners, and a support coupled to the mount stake between the first end and second end.

One feature of the present application includes a support spool operable to receive the mount stake.

Another feature of the present application includes wherein the support spool is structured to slidingly receive the mount stake.

Still another feature of the present application includes wherein the support is coupled to a gas turbine engine at a point upstream of the mount stake.

Still yet another feature of the present application includes a locating pin configured to position the support relative to the gas turbine engine.

Still another aspect of the present application includes an apparatus comprising a combustor including inner and outer liners, means for maintaining spaced relation between the inner and outer liners, and means for coupling the means for maintaining to a gas turbine engine structure upstream of the combustor.

Still a further aspect of the present application includes a method comprising spacing a gas turbine engine combustor inner liner from an outer liner, installing a mount stake between an inner liner and an outer liner of a gas turbine engine combustor, wherein the mount stake is structured to retain the spaced relation of the inner liner and the outer liner, and coupling the mount stake to a structure of the gas turbine engine at a point upstream of the mount stake.

A feature of the present application includes axially positioning the mount stake relative to the structure of the gas turbine engine with an alignment device.

Another feature of the present application includes wherein coupling the mount stake includes attaching the mount stake to a support assembly.

One aspect of the present application includes an apparatus comprising a gas turbine engine including a combustor having an inner casing, an outer casing, an inner liner, and an outer liner, a combustion passage formed between the inner liner and outer liner, an inner passage formed between the inner casing and the inner liner, and an outer passage formed between the outer casing and the outer liner, a mount stake extending between and coupling the inner liner to the outer liner; the mount stake having a first end and a second end, at least one of the first end and second end failing to fully extend across one of the inner passage and the outer passage, and a combustor support anchored with the gas turbine engine and extending into the combustor, the combustor support coupled to the mount stake intermediate the first end and the second end.

Another aspect of the present application includes a gas turbine engine combustor comprising a gas turbine engine having a compressor that provides a compressed working fluid to a diffuser downstream of the compressor, the gas turbine engine also having a mount stake traversing between inner and outer liners of a combustor, the mount stake having an intermediate portion coupled to a support that extends upstream of the mount stake toward the diffuser and between the inner and outer liners.

Yet another aspect of the present application includes an apparatus comprising a combustor including inner and outer liners, means for maintaining spaced relation between the inner and outer liners, and means for coupling the means for maintaining to a gas turbine engine structure upstream of the combustor.

Still another aspect of the present application includes a method comprising spacing a gas turbine engine combustor inner liner from an outer liner, installing a mount stake between an inner liner and an outer liner of a gas turbine engine combustor, wherein the mount stake is structured to retain the spaced relation of the inner liner and the outer liner, and coupling the mount stake to a structure of the gas turbine engine at a point upstream of the mount stake.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas turbine engine including a combustor having an inner casing, an outer casing, an inner liner, and an outer liner, a combustion passage formed between the inner liner and outer liner, an inner passage formed between the inner casing and the inner liner, and an outer passage formed between the outer casing and the outer liner, wherein the inner liner includes an inner liner opening, the outer liner includes an outer liner opening;

a mount stake that is elongate and radially extending between and coupling the inner liner to the outer liner, the mount stake having a first end and a second end and having a length longer than any dimension of a cross section taken along the length, the mount stake being circumferentially spaced from a neighboring mount stake such that a flow space is formed therebetween, at least one of the first end and second end failing to fully extend across one of the inner passage and the outer passage, where the mount stake is positioned such that is reaches through the inner liner opening and the outer liner opening; and a combustor support that extends upstream of the mount stake and is anchored with the gas turbine engine and extends into the combustor, the combustor support coupled to the mount stake intermediate the first end and the second end, further including a support spool coupled to the combustor support, and wherein the support spool is directly coupled to the mount stake.

2. The apparatus of claim 1, wherein the combustor support includes an opening through which the mount stake is received.

3. The apparatus of claim 1, wherein the gas turbine engine further includes a diffuser connected to the combustor support.

4. The apparatus of claim 1, wherein the support spool includes a passageway capable of receiving the mount stake.

5. The apparatus of claim 4, wherein the combustor support and support spool are separable, and which further includes an alignment device structured to position the support spool relative to the combustor support.

6. The apparatus of claim 1, wherein the combustor support includes a separable first portion and second portion, the first and second portion indexable relative to each other.

7. The apparatus of claim 1, wherein the combustor support is anchored with a diffuser.

8. An apparatus comprising:

a gas turbine engine having a compressor that provides a compressed working fluid to a diffuser downstream of the compressor, the gas turbine engine also having a casing located near the outer liner and a mount stake that is elongate and radially traversing between inner and outer liners of a combustor and having a radial length larger than any dimension of a cross section taken along the radial length, the mount stake being circumferentially spaced from an adjacent mount stake such that an open flow space is created therebetween, and wherein the mount stake fails to contact the casing, the mount stake having an intermediate portion coupled to a support that extends upstream of the mount stake toward the diffuser and between the inner and outer liners, wherein the mount stake directly connects the inner and outer liners, wherein the support includes a support spool, and wherein the support spool is directly coupled to the mount stake.

9. The apparatus of claim 8, wherein the support includes an opening operable to receive the mount stake.

10. The apparatus of claim 9, wherein the support includes a support bracket coupled to the support spool.

11. The apparatus of claim 10, wherein the support spool is structured to slidingly receive the mount stake.

12. The apparatus of claim 8, wherein the support is connected to the diffuser.

13. The apparatus of claim 8, which further includes a locating pin structured to position the support relative to the diffuser.

14. The apparatus of claim 9, wherein the support includes a support spool arm.

15. The apparatus of claim 8, which further includes a passageway formed in the support and structured to slidingly receive the mount stake.

16. A method comprising:

spacing an inner liner of a gas turbine engine combustor from an outer liner, the inner liner having a through passage and the outer liner having a through passage;

installing a mount stake that is elongate between the inner liner and the outer liner of a gas turbine engine combustor such that an outer end of the mount stake extends past the through passage of the outer liner and an inner end of the mount stake extends past the through passage of the inner liner, wherein the mount stake fails to contact a gas turbine engine casing located near the outer liner of the gas turbine engine, wherein the mount stake is radially oriented between the inner liner and outer liner and includes a radial length larger than a cross sectional dimension taken along the length of the mount stake, wherein the mount stake is structured to retain a spaced relation of the inner liner and the outer liner;

forming a flow space between the mount stake and a neighboring mount stake such that a bulk flow of working fluid is permitted to pass; and coupling an intermediate portion of the mount stake to a structure of the gas turbine engine at a point upstream of the mount stake further including a support assembly coupled to the structure of the gas turbine engine, and wherein the support assembly is directly coupled to the mount stake.

17. The method of claim 16, which further includes axially positioning the mount stake relative to the structure of the gas turbine engine with an alignment device.

18. The method of claim 16, wherein the support assembly is slidingly coupled to the mount stake.

19. The method of claim 16, wherein the coupling further includes engaging the support assembly to a gas turbine engine diffuser.

* * * * *